US010925349B2

(12) United States Patent
Boghossian

(10) Patent No.: US 10,925,349 B2
(45) Date of Patent: Feb. 23, 2021

(54) RELATING TO FOOTWEAR

(71) Applicant: JENNIFER CHAMANDI LIMITED, London (GB)

(72) Inventor: Jennifer Boghossian, London (GB)

(73) Assignee: JENNIFER CHAMANDI LIMITED, London (GB)

( * ) Notice: Subject to any disclaimer, the term of this patent is extended or adjusted under 35 U.S.C. 154(b) by 67 days.

(21) Appl. No.: 16/312,914

(22) PCT Filed: Jun. 30, 2017

(86) PCT No.: PCT/GB2017/051922
§ 371 (c)(1),
(2) Date: Dec. 21, 2018

(87) PCT Pub. No.: WO2018/002644
PCT Pub. Date: Jan. 4, 2018

(65) Prior Publication Data

US 2019/0320760 A1 Oct. 24, 2019

(30) Foreign Application Priority Data

Jul. 1, 2016 (GB) ..... 1611543.8

(51) Int. Cl.
*A43B 3/12* (2006.01)
*A43B 21/24* (2006.01)
(Continued)

(52) U.S. Cl.
CPC ..... *A43B 21/24* (2013.01); *A43B 3/12* (2013.01); *A43B 3/122* (2013.01); *A43B 3/244* (2013.01); *A43C 11/14* (2013.01)

(58) Field of Classification Search
CPC ..... A43B 3/12; A43B 3/122; A43B 3/128; A43B 3/244
(Continued)

(56) References Cited

U.S. PATENT DOCUMENTS 1,088,309 A * 2/1914 Weidt ..... A43B 3/126 36/11.5
1,753,702 A * 4/1930 Griffiths ..... A43B 5/08 36/8.1
(Continued)

FOREIGN PATENT DOCUMENTS

CN 103416904 A 12/2013
FR 897884 A 4/1945
(Continued)

OTHER PUBLICATIONS

Combined Search and Examination Report (GB Patent Application No. 1611543.8); dated Jul. 18, 2016; 10 pages.
(Continued)

*Primary Examiner* — Marie D Bays
(74) *Attorney, Agent, or Firm* — Howard & Howard Attorneys PLLC

(57) ABSTRACT

Articles of footwear 1, and methods of manufacturing articles of footwear are disclosed. The footwear 1 comprises a heel portion 4 for supporting a heel of a foot 10 of a wearer. The heel portion 4 defines a channel 20 extending from a first opening 21 to a second opening 22. The openings 21, 22 are situated at laterally-facing surfaces 41, 42 of the heel portion 4. The footwear 1 may also comprises a fastening means 5 for fastening the article of footwear 1 to the foot 10 of the wearer. The fastening means 5 is arranged to extend through said channel 20 and, in use of the footwear 1, is fastenable around the dorsal region of the foot 10 of the wearer.

18 Claims, 7 Drawing Sheets

(51) Int. Cl.
*A43C 11/14* (2006.01)
*A43B 3/24* (2006.01)

(58) Field of Classification Search
USPC ..... 36/11.5, 101, 58.5
See application file for complete search history.

(56) References Cited

U.S. PATENT DOCUMENTS 2,217,341 A * 10/1940 Kamborian ..... A43B 13/37 36/24.5
2,343,701 A * 3/1944 Pickens ..... A43B 3/128 36/11.5
2,402,227 A * 6/1946 Ihle ..... A43B 1/14 36/25 R
2,590,648 A * 3/1952 Pitz ..... A43B 3/128 36/11.5
2,607,133 A * 8/1952 Marlowe ..... A43B 3/24 36/11.5
3,455,037 A * 7/1969 Vlas ..... A43B 3/126 36/11.5
3,570,147 A * 3/1971 Chiu ..... A43B 3/24 36/100
4,224,748 A * 9/1980 Whitchurch ..... A43B 13/37 36/24.5
4,272,897 A * 6/1981 Ponce ..... A43B 23/22 36/24.5
4,854,056 A * 8/1989 Levin ..... A43B 3/126 36/58.5
6,895,695 B1 * 5/2005 Chen ..... A43B 13/30 36/24.5
7,398,607 B1 * 7/2008 Garcia ..... A43B 1/0072 36/101
2002/0100189 A1 8/2002 Manzi
2002/0124433 A1 * 9/2002 Pan ..... A43B 3/244 36/11.5
2005/0066549 A1 * 3/2005 Grivas ..... A43B 3/105 36/101
2007/0240335 A1 * 10/2007 Fitzgerald ..... A43C 7/00 36/101

FOREIGN PATENT DOCUMENTS

FR 926185 A 9/1947
FR 1003842 A 3/1952
FR 2882230 A1 8/2006
FR 2989560 A1 10/2013
GB 2526791 A 12/2015
WO 03/045177 A1 6/2003
WO 2012/116382 A1 9/2012

OTHER PUBLICATIONS

International Search Report (International Application No. PCT/GB2017/051922); dated Sep. 1, 2017; 3 pages.

* cited by examiner

RELATING TO FOOTWEAR

FIELD OF THE INVENTION

The present invention relates to an article of footwear. In particular, the present invention relates to an article of footwear comprising a removable fastening means. The present invention is particularly applicable to high-heeled shoes.

BACKGROUND TO THE INVENTION

There are many different styles and constructions of footwear. Generally, these can be classified as belonging to one of two main types: those without and those with a fastening means. The former will be hereinafter generally referred to as "slip-on" footwear.

Slip-on footwear, including many formal high-heeled shoes, do not have any fastening means. Accordingly, a comfortable and reliable interference fit between a shoe and the foot of wearer is important. If the fit is not tight enough, then the footwear is likely to slip off from the wearer's foot unintentionally, and if the fit is too tight in certain regions, then this can lead to chafing, blisters and even injury.

Some of these problems are alleviated by "non-slip-on" footwear that has a fastening means. A fastening means, such as an adjustable strap and buckle, allows the wearer to control the fit and level of engagement between a wearer's foot and the footwear. Such a fastening means is usually integral with the design of the footwear, often being permanently attached to the footwear. For example, straps may be integral with the upper of an article of footwear. This leads to a different style and construction of footwear which may be undesirable or inappropriate for certain occasions that demand slip-on footwear. Consequently, users tend to own many different pairs of footwear, for different occasions.

An alternative approach is to provide an article of footwear that can be readily converted from a slip-on type without a fastening means, to a non-slip-on type with a fastening means.

Most articles of footwear do not support such a conversion. Dedicated slip-on footwear often has nowhere for the fastening means to be connected, and dedicated non-slip-on footwear is likely to be ruined following any attempt to modify it. In particular, removing fastening means originally integral with an article of footwear is likely to damage or significantly detract from the appearance and function of footwear; fastening means and other fit adjustment articles, for example straps, eyelet or loops are often permanently attached to footwear.

Where an item like a strap can be unthreaded without damage from an underlying structure such as an eyelet, such structures will be left behind on footwear. This is undesirable and especially unsightly when such structures are disposed on an upper of the footwear. It will be noted that many formal articles of footwear, especially high-heeled footwear, are substantially free of adornments in this upper region, and so a mere unthreading, even if it is possible, is often not a satisfactory conversion. Additionally, footwear may not remain on a wearer's foot reliably without the fastening means.

Mindful of these considerations, a simple and user-friendly way of converting between these two footwear types is required without detracting from the appearance or function of an article of footwear.

US20130326907A contemplates a shoe accessory that addresses this requirement in part. The accessory has a heel loop connected to an ankle loop. The ankle loop attaches to the ankle of the shoe wearer, and the heel loop encircles the heel of the shoe thereby anchoring the shoe to the ankle of the wearer.

GB2492898A describes a similar arrangement wherein the heel portion is formed as a sleeve for passing over the heel of a shoe, with an ankle portion for surrounding and attaching to a person's ankle.

Whilst these arrangements permit switching between "slip-on" and "non-slip-on" footwear, there is a continual need in the art to provide improvements or alternatives that address the above-mentioned issues.

It is against this background that the present invention has been devised.

SUMMARY OF THE INVENTION

According to a first aspect of the present invention there is provided an article of footwear comprising a heel portion for supporting a heel of a foot of a wearer, the heel portion defining a channel. Preferably, the channel extends from a first opening situated at a first surface of the heel portion to a second opening situated at a second surface of the heel portion. Preferably, the first surface is a first laterally-facing surface. The second surface may be a laterally-facing surface. The first and second surfaces of the heel portion may be opposed to one another. Preferably, the article of footwear further comprises a fastening means for fastening the article of footwear to the foot of the wearer. Preferably, the fastening means is arranged to extend through said channel and, in use of the footwear, around the foot of the wearer of the article of footwear.

Specifically, the fastening means may be arranged to extend through said channel and, in use of the footwear, around the dorsal region of the foot of the wearer.

Advantageously, the openings are conveniently located at respective laterally-facing surfaces of the heel portion of the article of footwear, thereby facilitating the fitting and removal of the fastening means by the wearer.

Moreover, the channel may be positioned and arranged to be accessed by a wearer when the article of footwear is being worn by the wearer, thereby allowing the wearer to convert the footwear between a slip-on and non-slip-on type without removing the article of footwear. Manual threading by the wearer of a fastening means through the channel may convert the article of footwear from a slip-on to a non-slip-on type. Manual unthreading by the wearer of the fastening means from the channel may convert the article of footwear from a non-slip-on to a slip-on type.

Preferably, the first and second surfaces are external surfaces of the heel portion. Accordingly, the first and second surfaces may be outwardly-facing surfaces, and may face away from one another. This can make it particularly easy for a wearer to fit or remove the fastening means, as this can be achieved even when the wearer is wearing the article of footwear. This allows quick and easy conversion of the article of footwear between a slip-on and non-slip-on type. Specifically, the article of footwear may be convertible from a slip-on type to a non-slip-on type via provision of the fastening means. Conversely, the article of footwear may be convertible from a non-slip-on type to a slip-on type via removal of the fastening means. Preferably, the channel extends uninterrupted between the first and second openings when the article of footwear is being worn by a wearer. This further facilitates conversion even when the article of footwear is being worn by the wearer.

There may be only a single channel through which the fastening means extends. Therefore, there may be only a single channel through which the fastening means may be threaded or unthreaded, and this further minimises the burden of providing or removing the fastening means. This is in contrast with other footwear arrangements where there may be a series of channels such as eyelets through which a shoe-lace may be typically threaded and unthreaded.

Preferably, the fastening means, when fastened, forms a complete loop that passes through the channel and, in use of the footwear, also around the foot of the wearer, thereby retaining the footwear to the foot of the wearer.

Advantageously, a portion of the fastening means that passes through the channel is captured within the channel, thereby retaining the fastening means to the footwear, even when the fastening means is unfastened. Accordingly, when the footwear is removed, this reduces the chance of the fastening means coming away from the rest of the footwear unintentionally.

As mentioned, the heel portion supports a heel of the wearers foot. Accordingly, it will be understood that the channel may run within the heel portion, underneath and across the bottom of the foot of the wearer of the article of footwear.

The fastening means may be in the form of a flexible elongate article. For example, the fastening means may comprise a strap. The strap may be constructed from a flexible material such as leather. The fastening means may comprise a fastener such as a buckle. The fastener may be at one end of the fastening means, with a complementary fastening structure at another end. For example, if the fastener is a buckle, then the complementary fastening structure may be defined by a strap having holes disposed therein.

Ideally, the fastener and the complementary fastening structure are releasably connectable with one another. Connection of the fastener and the complementary fastening structure forms a loop, and disconnection breaks the loop otherwise formed by the fastening means.

Accordingly, when the fastening means is unfastened to break the complete loop that would otherwise extend around the foot of the wearer, a portion, preferably a central portion between the ends of the fastening means is captured within the channel. This reduces the chance of the fastening means coming away from the rest of the footwear unintentionally and, due it is relatively small size, being lost. This is assisted by the fastening means having one end that is too large to pass through the channel, for example due to the presence of a fastener such as a buckle.

Naturally, if the wearer of the article of footwear intends to unthread the fastening means from the channel entirely this can be quickly done by pulling one end of the fastening means. If the fastening means has a fastener at one end that is too large to pass through the channel, then that end can be pulled by the wearer to drag the relatively smaller other end of the fastening means through the channel.

Preferably, a bore profile of the channel is substantially regular between the first and second openings. In other words, the cross-sectional size of the bore of the channel preferably does not vary sharply along the length of the channel. Advantageously, this facilitates threading and unthreading of the fastening means through the channel. It will be appreciated that whilst the bore profile may vary along the length of the channel, between the first and second openings, any such variation is substantially smooth enough to avoid snagging of a fastening means threaded through the channel. Furthermore, it is preferred that the channel comprises smooth internal walls, for example, constructed from a smooth and/or polished metallic material. Accordingly, a fastening means urged through one of the first and second openings is guided smoothly by the internal walls so as to exit from the other of the first and second openings, even if the fastening means is constructed from a flexible elongate material, such as a strap.

More generally, the fastening means and the channel defined by the heel portion have properties that enable manual threading of the fastening means through said channel. Such properties may including at least one of: the length of the channel, the stiffness of the fastening means, the relative cross-sectional area of the channel and the fastening means, and the frictional engagement between the channel and the fastening means. Conveniently, manual threading can be achieved quickly and easily by a wearer without recourse to tools.

The heel portion may comprise a sleeve portion. The sleeve portion may be positioned and arranged to surround and define the channel and/or at least one of the first and second openings, at least in part. The heel portion may comprise a body. The sleeve portion may be embedded within the body of heel portion, at least in part. To this end, the body may comprise a conduit within which at least a part of the sleeve portion is inserted. Ideally, the conduit is aligned with the path of the channel, the conduit extending between openings in the first and second surfaces of the heel portion. Ideally, an internal cross-sectional profile of the conduit and an external cross-sectional profile of a part of the sleeve portion inserted into the conduit, closely conform to one another so that the sleeve portion can be securely embedded, via interference fit, within the conduit.

Preferably, the sleeve portion is hollow to allow threading through of the fastening means. The sleeve portion may comprise walls extending in a broadly tubular arrangement between first and second open ends. The first and second open ends of the sleeve portion may thereby respectively correspond to the first and second openings of the channel. Accordingly, whilst the sleeve portion may be substantially embedded within the body of the heel portion, at least one of the ends of the sleeve portion are preferably situated at an external region of the body of the heel portion, and so may be accessible to a wearer of the article of footwear for convenient threading or unthreading of the fastening means.

Advantageously, the sleeve portion can improve the structural integrity of the channel, especially if the sleeve portion is predominantly constructed of a material that is proportionally stronger than that from which the body is predominantly constructed. For example, the body of the heel portion may be predominantly constructed from a durable plastics material such as acrylonitrile butadiene styrene (ABS) whereas the sleeve portion may be predominantly constructed from a metal such as brass. Preferably the metal is plated, for example gold-plated, to improve the appearance of the sleeve portion as at least a part of the sleeve portion may be visible during use of the footwear.

This arrangement also improves the durability and reliability of the footwear. The fastening means may abrade the material surrounding the channel and/or the first and second openings during use of the footwear, and this, over time, can detract from the appearance of the fastening means or the material into which it comes into frictional contact. The use of a material such as a metallic material, that is both durable and smooth can minimise such wear via abrasion. Moreover, the sleeve portion may define a mantle around at least one of the first and second openings of the channel. This can reduce wear at the regions that are liable to suffer from it the most.

Preferably, the sleeve portion comprises a stem arranged to be embedded within the body. Preferably, the internal cross-sectional profile of the conduit of the body and the external cross-sectional profile of the stem of the sleeve portion, closely conform to one another so that the sleeve portion can be securely embedded, via interference fit, within the conduit. Ideally, said cross-sectional profile of the conduit and/or the stem are shaped and arranged to facilitate insertion of the stem into the conduit during fitment of the sleeve portion to the body. For example, to facilitate sliding insertion, the cross-sectional profile of the conduit and/or the stem may be constant, or narrow inwardly into the body. A relatively constant cross-sectional area is preferred, as this maximises the frictional engagement between the sleeve portion and the body, and so far better retains these two articles to one another. Additionally, a regular cross-sectional profile of the conduit of the body, and/or of the sleeve portion simplifies the manufacture of the article of footwear. If the body is moulded, for example, from a plastics material such as ABS, such a profile can assist in the extracting of the heel portion from the mould. A similar advantage applies to the sleeve portion which may also be moulded, for example, from a silicon rubber mould.

Preferably, the sleeve portion is constructed of a rigid, durable material, ideally a metal, that maintains its form despite such frictional forces when the sleeve portion is driven into the body during assembly.

Preferably, the sleeve portion comprises one or more flanges. Each flange may be located at a respective end of the sleeve portion, and may have an external cross-sectional profile that prevents insertion into the conduit of the body. Specifically, the external cross-sectional profile of the flange may extend beyond the external cross-sectional profile of the part of the sleeve portion inserted into the conduit. Thus, the stem and the flange together can facilitate correct insertion of the sleeve portion to the desired extent into the conduit defined by the body, with the flange limiting the depth of insertion.

Preferably, a length of the stem of the sleeve portion substantially matches the length of the conduit of the body of the heel portion. Beyond the stem, the sleeve portion terminates at said one or more flanges.

The flange, when located at the end of the sleeve portion, may conveniently provide a mantle around one of the first and second openings of the channel. An inwardly-facing shoulder of the flange may be shaped and/or oriented in complement with a respective outwardly-facing surface of the body. This can facilitate even engagement between the flange and the body of the heel portion, improving the appearance and function of the sleeve portion, and the article of footwear in general. The respective outwardly-facing surface of the body with which the flange engages may define a recess into which the flange may locate.

An outwardly-facing region of the flange is preferably rounded. This avoids sharp edges being presented external to the article of footwear, which is especially important if the flange extends proud of the respective outwardly-facing surface of the body in the region of that flange. Advantageously, these features can minimise wear of the fastening means, and moreover can prevent the flange from catching on skin or other articles of clothing. Additionally, the outwardly-facing region of the flange, which may extend proud of the respective outwardly-facing surface of the body, allows the fastening means to slide smoothly over the outside of the shoe, enhancing adjustment.

Moreover, the sleeve portion may be constructed from a plurality of components. For example the sleeve portion may be of a two-piece construction. At least one of the plurality of components is made from an integral piece of material.

Preferably, a first component comprises a first portion of the stem and a first flange. A second component may comprise a second portion of the stem and a second flange.

The first and second components may be assembled together and fitted as part of the heel portion by driving them into the conduit of body. Specifically, the first and second stem portions may be driven into the conduit via respective first and second conduit apertures, such that the respective ends of the first and second stem portions meet within the conduit. Preferably, insertion causes the respective flanges of the first and second components to meet with the respective external laterally-facing surface of the heel portion. Ideally, at the same depth of insertion, the flanges abut their respective external laterally-facing surfaces, and the respective ends of the first and second stem portions meet within the conduit. Adhesive may be applied to regions of the sleeve portion, for example at the meeting ends of the first and second stem portions, to retain the sleeve portion within the conduit when fitted. This simplified manufacture, as does a two-piece construction: Adhesive may be applied, and the components are simply pushed into the conduit.

It should be noted that whilst the sleeve portion extends in a broadly tubular arrangement, neither it, nor the channel defined by it is necessarily restricted to having a circular cross-section. Other cross-sectional profiles are also envisaged. Moreover, it is preferred that the cross-sectional profile of the channel broadly conforms to the structure surrounding the channel. For example, when the article of footwear is viewed laterally, if the heel portion tapers inwardly down to the ground, as is the case with most high-heeled shoes, then it is preferred that the cross-sectional profile of the channel also tapers accordingly. For example, the cross-sectional profile of the channel may be tear-drop-shaped, with the point of the tear-drop facing down, and so tapering in the same direction as the heel.

Advantageously, this can provide an ideal trade-off between the bore size of the channel, and the strength of the heel portion. Conformity between the bore of the channel and the surrounding structures minimise stress concentrations in any one particular part of those surrounding structures. This is especially important for footwear such as high-heeled shoes that may have relatively slender heel portions as compared to other footwear.

Naturally, such a construction also maximises the strength-to-weight characteristics of the footwear.

Other features of the heel portion are also useful in optimising the strength-to-weight characteristics of the footwear, especially for footwear such as high-heels. For example, the heel portion may comprise a core extending between a heel seat of the article of footwear, and the ground on which the article of footwear stands in normal use. Preferably, the core is constructed of a material that is stronger than the body of the heel portion. For example, the core may be of a metal material such as steel, whereas the body is constructed from a plastics material such as ABS. Ideally, the core is constructed from an integral piece of material. Preferably, the core is at least partly internal to the body, with the body being moulded, for example via injection moulding, around the relevant internal part of the core. Ideally, the channel extends across a path that avoids the core.

Ideally, the part of the core internal to the body comprises a branch region. Advantageously, this can facilitate cohesion between the core and the body that is moulded around the branch region. Additionally, this can prevent relative movement between the core and the body, and can help distribute impact forces transmitted via the core over a wider area. This can improve the comfort of the article of footwear and also minimise the chance of structural failure.

A lower end of the heel portion may terminate at a heel tip. Preferably, the heel tip is constructed from a material that is more resilient than the body of the heel portion, for example, rubber. The heel portion may comprise a fixing means for fixing the heel tip to the body and/or the core. The fixing means may comprise a screw thread.

Preferably the channel extends laterally across the width of the heel portion of the footwear. Advantageously, as the channel extends across the entire width of the heel portion, the forces applied to a fastening means threaded through the channel, in use of the footwear, are spread over a wide area. This ensures that the fastening means does not receive these forces at a single location along its length, thereby increasing the longevity and appearance of the fastening means, and the footwear in general. This is in contrast with structures such as eyelets and shoelaces which, over time, are more likely to fail as a result of stress being applied by the eyelet to the same location, for example, of a shoelace.

This arrangement means also that the channel is oriented such that ends of a fastening means that emerge from the channel extend laterally away from one another and also from the foot. This makes it easier for a wearer to pick up these free ends and loop them about the dorsal region of the wearer's foot. Additionally, the positioning of the channel within the heel portion enhances the comfort and efficacy of the fastening means. It may be positioned approximately orthogonal to the direction that the foot extends so that the fastening means can arch over the top of the foot in conformity with the natural shape of that part of the foot.

Preferably, the channel is situated at the front of the heel portion, close to a transition between the heel portion and an arch of the article of footwear.

Preferably, the fastening means is flat in the region that is arranged, in use, to loop around and engage with the dorsal region of the wearer's foot. This can increase the comfort of the fastening means. This is subject to the flat region of the fastening means being flush with the corresponding dorsal region of the wearer's foot. Naturally, different users may have different shaped feet. Therefore to improve the adaptability of the article of footwear, it is preferred that the fastening means is able to pivot relative to the channel in which it is captured so that the flat region of the fastening means can be oriented to be flush with the foot of the wearer. Preferably, the path along which the channel extends defines the pivot axis of the fastening means.

Accordingly, the cross-sectional area of a central portion of the fastening means that extends through the channel is significantly smaller than the cross-sectional size of the bore of the channel. This permits the fastening means to pivot freely within the channel without twisting or buckling of the fastening means. This can reduce the wear on the fastening means, maintaining its appearance and integrity over time. The cross-sectional area of the central portion of the fastening means may be less than 90% of the cross-sectional size of the bore of the channel. Preferably, the cross-sectional area of the central portion of the fastening means is less than 60% of the cross-sectional size of the bore of the channel. More preferably, the cross-sectional area of the central portion of the fastening means is less than 30% of the cross-sectional size of the bore of the channel.

Advantageously, the fastening means can be connected to the rest of the article of footwear at a position that is a lot further back from the dorsal region of the foot as compared with other styles of footwear which may have fastening structures on the upper. As the pivot axis for the fastening means is a lot further back, the radius of curvature followed by the loop of the strap is larger. This makes it easier for a wearer of the shoe to engage the strap at the most comfortable part of the top of the foot, and at the same time for the strap to lie flatter than it would for a smaller radius of curvature.

Preferably, the article of footwear comprises an upper for covering at least a portion of the upper part of a wearer's foot. Preferably, the upper is arranged to form an interference fit with a foot of the wearer of the article of footwear.

Preferably, the upper presents a substantially smooth, continuous and/or uninterrupted external surface. Preferably, this external surface is free of structures that may otherwise be used for fastening, such as eyelets and buckles, as well as other adornments. Advantageously, such an upper can facilitate the cleaning, polishing and/or general maintenance of an item of footwear. Notably, dirt cannot easily collect on such an upper, and shoe-care substances such as polish can be more evenly distributed.

Advantageously, the article of footwear allows the benefits of such an upper to be retained at the same time as providing a fastening means. This is due to the provision of the channel within the heel portion of the article of footwear. The capture of the fastening means by the channel in the region obviates the disruption of the upper of the article of footwear: neither the fastening means, nor any intermediate structure, need be provided on the upper.

As mentioned, the heel portion may define a channel extending from a first opening situated at a first surface of the heel portion to a second opening situated at a second surface of the heel portion. Preferably, the openings are situated at laterally-opposed positions on the heel portion, allowing the fastening means to loop evenly over the dorsal region of the foot. Moreover, the openings are situated at respective laterally-facing surfaces of the heel portion at substantially the same height from the ground on which the article of footwear stands in normal use. The channel may be level relative to the ground on which the footwear stands in normal use. This can improve the comfort and fit of the fastening means.

Preferably, the openings and/or channel are situated closer to a heel seat of the article of footwear than the ground. The distance from the openings and/or channel to the ground may be greater than the distance from the openings and/or channel to the heel seat by a factor of at least 1.2. Preferably, the factor is at least 2. More preferably, the factor is at least 3. Most preferably, the factor is at least 4. Advantageously, by situating the openings and/or channel close to the heel seat of the article of footwear, the fastening means can be more reliably engaged with the foot of the wearer of the article of footwear, especially of articles of footwear that have a relatively high heel portion.

Naturally, the present invention extends to a footwear pair. For the avoidance of doubt, features corresponding to one article of footwear in a pair are generally present in the other article of the pair, with appropriate modifications being apparent to a person skilled in the art, for example associated with the natural chirality of feet, and therefore shoes.

According to a second aspect of the present invention there is provided an article of footwear of a non-slip-on type arranged for conversion to a slip-on type, the article of footwear comprising a heel portion for supporting a heel of a foot of a wearer, the heel portion defining a channel extending from a first opening situated at a first laterally-facing surface of the heel portion to a second opening situated at a second laterally-facing surface of the heel portion, the article of footwear further comprising a fastening means extending through said channel, conversion to a slip-on type of footwear resulting from removing, such as manual unthreading of, the fastening means from said channel.

According to a third aspect of the present invention there is provided an article of footwear of a slip-on type arranged for conversion to a non-slip-on type, the article of footwear comprising a heel portion for supporting a heel of a foot of a wearer, the heel portion defining a channel extending from a first opening situated at a first laterally-facing surface of the heel portion to a second opening situated at a second laterally-facing surface of the heel portion, conversion to a non-slip-on type of footwear resulting from providing, such as via manual threading of, a fastening means through said channel, the fastening means being looped around the foot of the wearer of the article of footwear, in use, to fasten the article of footwear thereto.

According to a fourth aspect of the present invention, there is provided a method of manufacturing an article of footwear according to the first, second and/or third aspects of the present invention.

According to the fifth aspect of the present invention there is provided a method of manufacturing an article of footwear. The method may comprise forming a heel portion for supporting a heel of a foot of a wearer, the heel portion defining a channel extending from a first opening situated at a first laterally-facing surface of the heel portion to a second opening situated at a second laterally-facing surface of the heel portion.

The method may comprise constructing a sole and connecting the sole to an upper. The sole may comprise the heel portion. The method may comprise forming, providing or combining components relating to features of the first, second and/or third aspects of the present invention. For example, the method may comprise providing a fastening means. The method may comprise forming a sleeve portion.

Preferably, the step of forming a heel portion comprises forming a body defining a conduit, and then inserting at least a part of a sleeve portion into the conduit, the sleeve portion being positioned and arranged to define the channel. Preferably, insertion of at least a part of the sleeve portion into the conduit comprises sliding insertion. Preferably, an internal cross-sectional profile of the conduit and an external cross-sectional profile of the part of the sleeve portion inserted into the conduit closely conform to one another, and ideally are substantially regular, so that the sleeve portion can be securely embedded, via interference fit, within the conduit. This facilitates sliding insertion. Moreover, manufacture via moulding or casting is facilitated by a regular cross-sectional shape as the body and/or sleeve portion can be withdrawn more readily from a mould or cast.

The step of forming a body may comprise moulding the body from a material such as a plastics material. For example, the body may be injection-moulded from a plastics material such as acrylonitrile butadiene styrene (ABS). The method may comprise forming the sleeve portion from a first material, preferably a metallic material such as brass. In such a case, forming the sleeve portion may involve moulding or casting the metallic material. The step of forming the sleeve portion may further comprise moulding or casting the shape of the sleeve portion with a first material, and then plating the first material with a second material, such as gold.

Preferably, the step of forming the sleeve portion may comprise forming the sleeve portion from a plurality of components, with: a first component comprising a first portion of a stem of the sleeve portion and a first flange; and a second component comprising a second portion of the stem and a second flange. Preferably, the step of forming the sleeve portion comprises moulding or casting each of the first and second components from an integral piece of the first material.

Preferably, the step of inserting the sleeve portion into the conduit of the body comprises driving into the conduit via respective apertures the first and second stem portions until respective flanges abut respective external laterally-facing surfaces of the body.

Preferably, the method may comprise, prior to the step of inserting the sleeve portion into the conduit, the step of applying adhesive to regions of the sleeve portion.

Preferably, the method of forming the heel portion comprises moulding the body around at least a part of a core. The method of forming the heel portion may comprise fixing a heel tip to the body and/or the core, the heel tip being constructed from a material that is more resilient than the body of the heel portion.

Naturally, the present invention also extends to a method of manufacturing a footwear pair.

It will be understood that features and advantages of different aspects of the present invention may be combined or substituted with one another where context allows.

BRIEF DESCRIPTION OF THE DRAWINGS

In order for the invention to be more readily understood, embodiments of the invention will now be described, by way of example only, with reference to the accompanying drawings in which.

SPECIFIC DESCRIPTION

Figure 1:
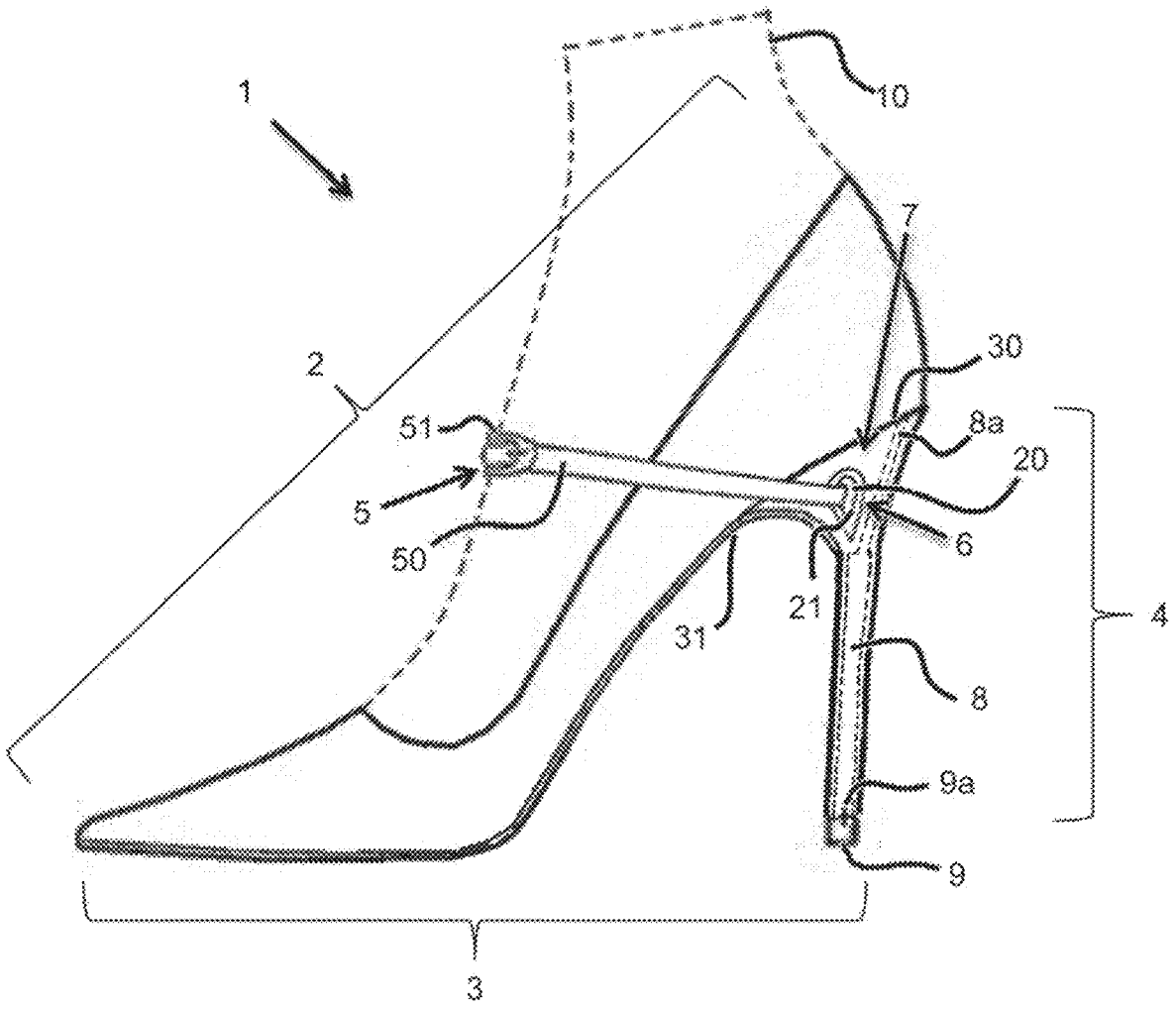
FIG. 1 is a lateral schematic view of an article of footwear in accordance with a first embodiment of the present invention.

FIG. 1 is a lateral schematic view of an article of footwear 1 in accordance with to a first embodiment of the present invention. The article of footwear 1 is in the form of a formal high-heeled shoe, specifically, the left shoe of a pair. In the interests of brevity, the right shoe is not shown or described, as it is simply a mirrored version of the left shoe.

The article of footwear 1 is broadly characterised by a predominately leather upper 2 for covering at least a portion of the upper part of a wearer's foot 10, and a sole 3 for supporting the underside of the wearer's foot 10. The sole 3 and upper 2 interact to form an interference fit with the wearer's foot 10.

As with other formal shoes, the upper 2 presents a substantially smooth external surface that is free of structures that may otherwise be used for fastening, such as eyelets and buckles, as well as other adornments.

The sole 3 of the article of footwear 1 comprises a heel portion 4 at the rear of the shoe, an arch 31 between the rear and the front of the shoe, and a heel seat 30 surmounting the heel portion 4. The sole 3 of the article of footwear 1 may also comprise other features that are common in the art, for example an out-sole and a shank. The heel portion 4 is arranged to support a heel of a foot 10 of a wearer at a significantly elevated position relative to the toes of the foot 10 of the wearer, as is typical with high-heeled shoes.

The article of footwear 1 further comprises a fastening means 5, having a flat strap 50 and a fastener 51, the fastener 51 being in the form of a buckle 51. As will be described in further detail below, in use, the fastening means 5 loops evenly over the dorsal region of the foot 10 of the wearer.

The heel portion 4 also comprises a sleeve portion 6, a body 7, a core 8 and a heel tip 9. The sleeve portion 6 defines a single channel 20, running laterally through the body 7 of the heel portion 4, the channel 20 and sleeve portion 6 both being situated at the front of the heel portion 4, close to a transition between the heel portion 4 and an arch 31 of the article of footwear 1.

The core 8 is partially embedded within the body 7, and takes the form of a steel riser which extends from a heel tip 9 to the heel seat 30 along a path that avoids the channel 20. The core 8 bends rearward at its upper end to avoid the channel 20, but predominantly extends in a roughly vertical orientation. The core 8 connects at its lower end to the heel tip 9 which is fixed to the core 8 via a screw 9*a*. Accordingly, the core 8 comprises, at its lower end a screw-thread to receive the screw 9*a*. The heel tip 9 is constructed from rubber, or another suitably resilient material.

Figure 2:
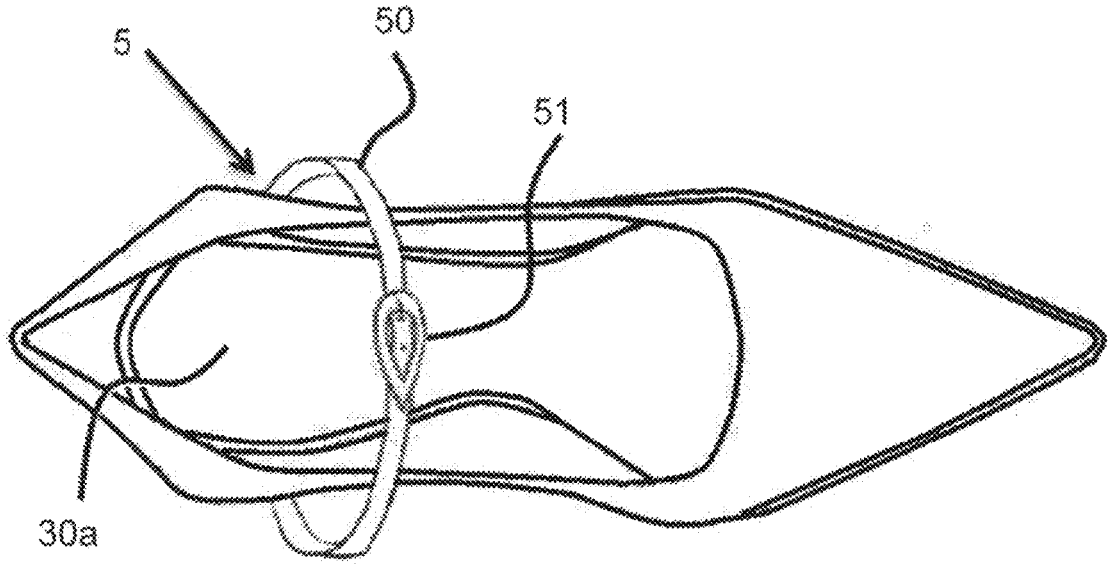
FIG. 2 is an overhead schematic view of the article of footwear of FIG. 1.

Referring to FIG. 2 which is a schematic overhead view of the article of footwear 1, the heel seat 30 defines an interface between the heel portion 4 and a region of an insole 30*a* on which the heel of a wearer of the article of footwear 1 may rest.

Figure 3A:
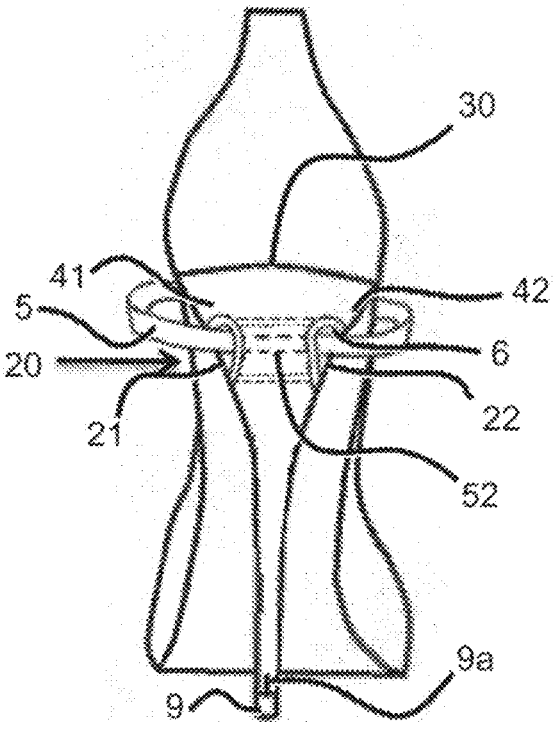
FIG. 3*a* is a first rear schematic view of the article of footwear of FIG. 1.
Figure 3B:
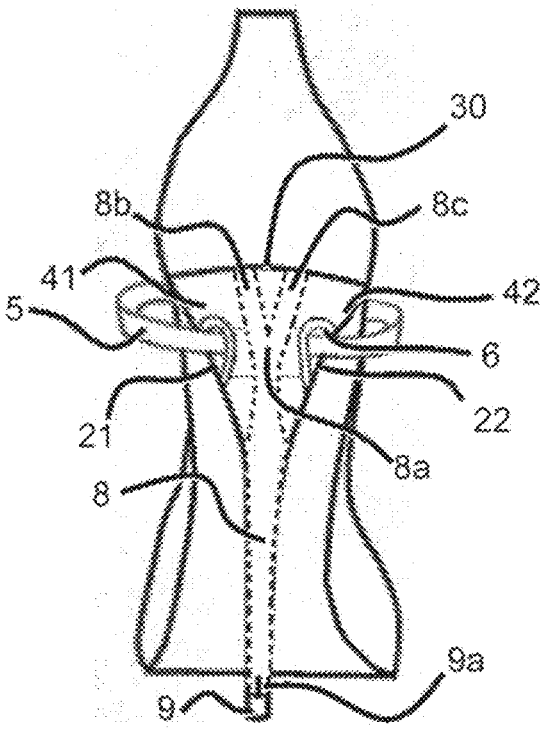
FIG. 3*b* is a second rear schematic view of the article of footwear of FIG. 1.
Figure 4:
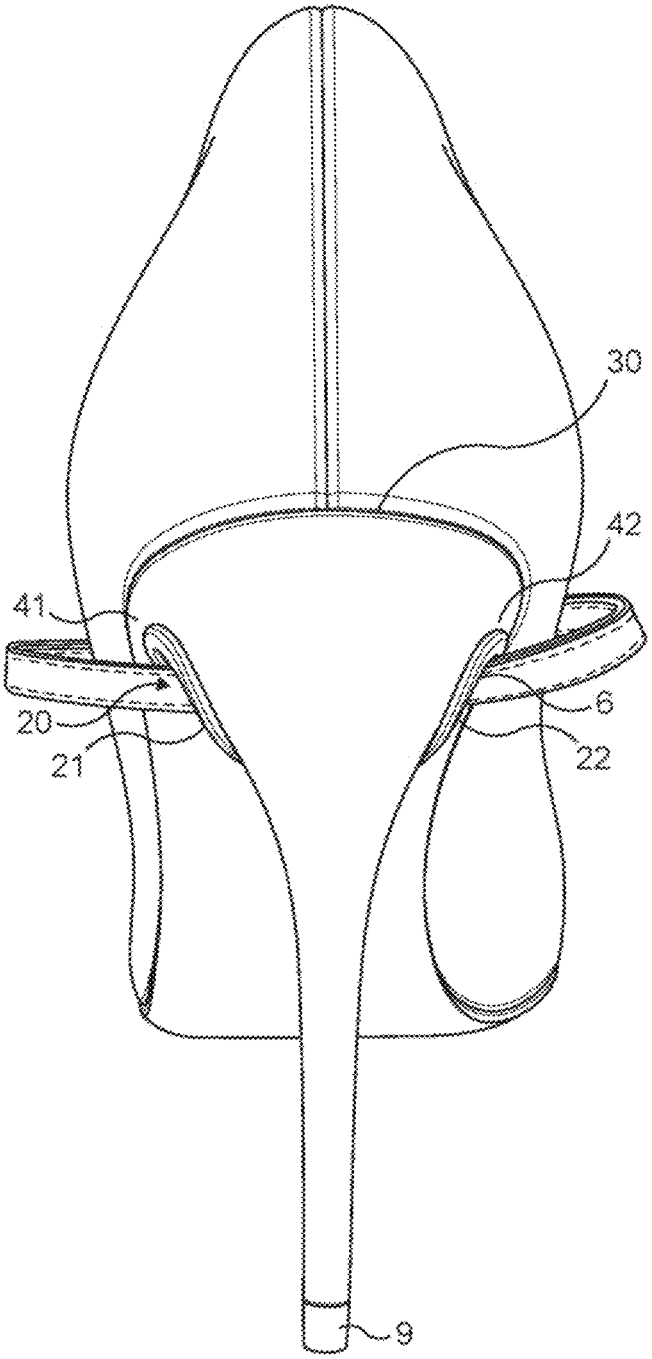
FIG. 4 is a rear view of the article of footwear of FIG. 1.

Referring to FIGS. 3*a*, 3*b* and 4 which are rear views of the footwear 1, the heel portion 4 comprises a first surface 41 within which a first opening 21 is formed. The heel portion 4 further comprises a second surface 42 within which a second opening 22 is formed.

FIGS. 3*a* and 3*b* are rear schematic views of the article of footwear 1, with FIG. 3*a* emphasising the structure of the channel 20, and FIG. 3*b* emphasising the structure of the core 8. However, it will be understood that these features are both present in the current embodiment, and their omission from either FIG. 3*a* or FIG. 3*b* is for visual clarity.

As best illustrated in FIG. 3*a*, the channel 20 extends laterally across the width of the heel portion 4 of the footwear 1 between the first opening 21 and the second opening 22 uninterrupted by any other structures of the heel portion 4. However, the fastening means 5 extends through the channel 20 with a central portion 52 of the fastening means 5 being internal to and captured by the channel 20.

Referring to FIG. 3*b*, the upper end of the core that bends rearward to avoid the channel 20 forms a Y-shaped branch region 8*a* of the core, with the trunk of the branch connecting to the broadly rod-shaped lower end of the core 8, and upper split ends of the branch 8*b*, 8*c* extending to the heel seat 30.

The first and second surfaces 41, 42 are on opposed regions of the heel portion 4, and face outwardly from the heel portion 4, away from one another. Specifically, the first surface 41 is on the left side of the shoe, and substantially faces left, and the second surface is on the right side of the shoe, and substantially faces right.

The first and second surfaces 41, 42, within which the openings 21, 22 are formed, are oriented slightly rearward and downward. However, they are predominantly laterally-facing such that the channel 20 that extends between the two surfaces 41, 42 can do so linearly, and in a lateral orientation that is level with the ground on which the article of footwear 1 rests. The openings 21, 22 are thus at substantially the same height from the ground. The channel 20 runs within the heel portion 4, underneath and across the bottom of the foot 10 of the wearer of the article of footwear 1. Furthermore, as shown, the openings 21, 22 and the channel 20 are situated significantly closer to the heel seat 30 of the article of footwear 1 than the ground.

Figure 5A:
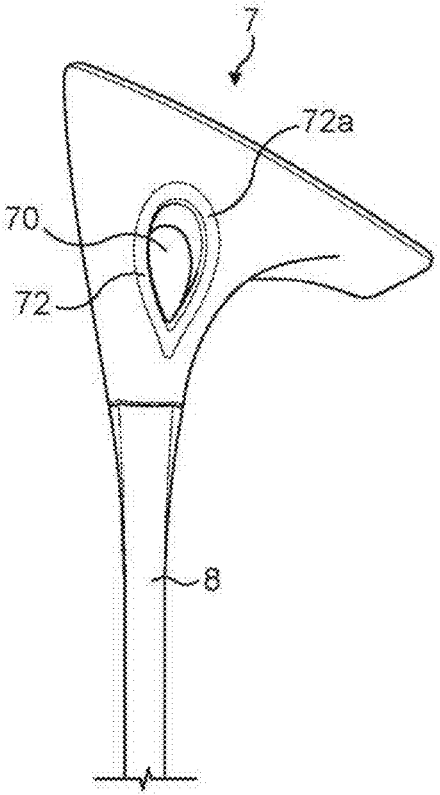
FIG. 5*a* is a partial perspective lateral view of a body and a core of a heel portion of the article of footwear of FIG. 1, the body and core being shown in isolation.
Figure 5B:
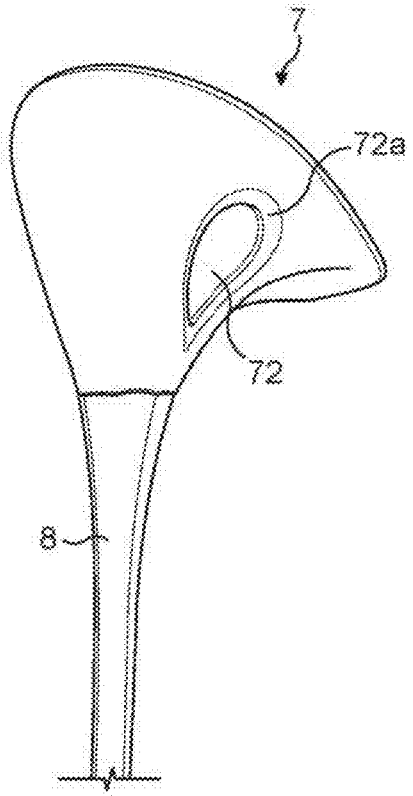
FIG. 5*b* is a partial perspective view of the body and core of FIG. 5*a;*
Figure 5C:
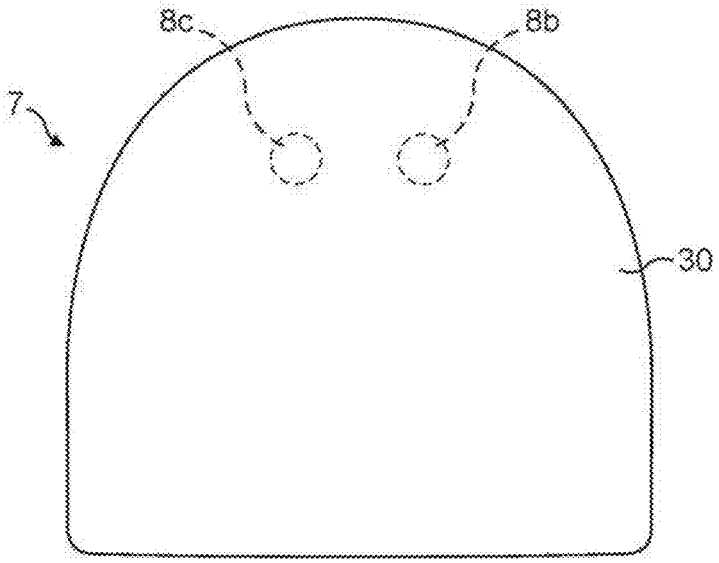
FIG. 5*c* is an overhead view of the body and core of FIG. 5*a;*

FIGS. 5*a* to 5*e* show the body 7 and the core 8 of the heel portion 4 in isolation. As can be seen, the Y-shaped branch region 8*a* of the core 8 is embedded within the body 7, whereas the broadly rod-shaped lower end of the core 8 protrudes from the body. Thus, the core 8 is partially embedded within the body 7. The body 7 is partially translucent, and so the embedded part of the body 7 is visible as a darkened region within the body 7. For example, FIG. 5*c* shows the upper split ends 8*b*, 8*c* of the branch 8*a* that extend almost to the surface of the heel seat 30 as two dark spots.

Figure 5D:
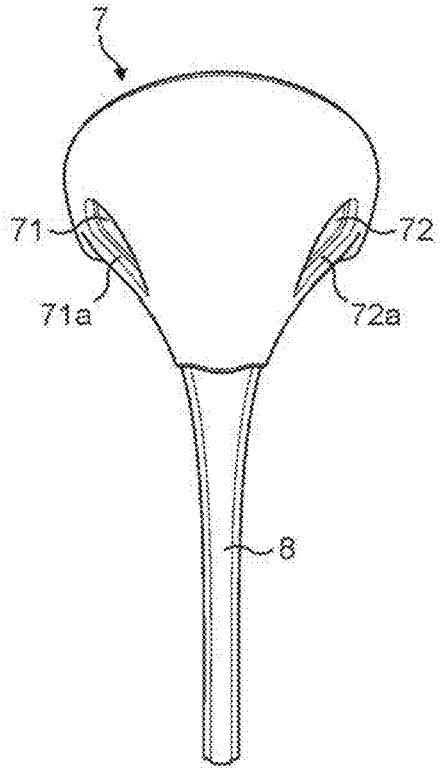
FIG. 5*d* is a rear perspective view of the body and core of FIG. 5*a;*
Figure 5E:
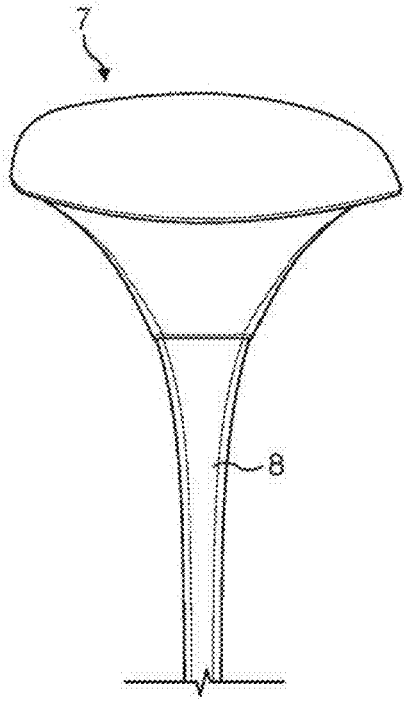
FIG. 5*e* is a front partial perspective view of the body and core of FIG. 5*a;*
Figure 6:
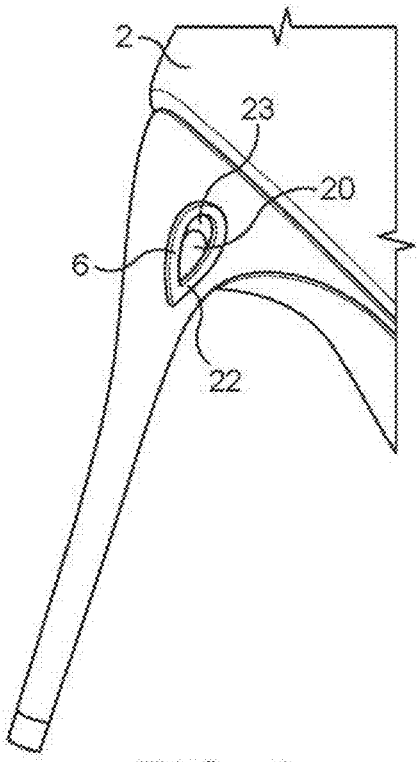
FIG. 6 is a partial perspective lateral view of the rear of the article of footwear of FIG. 1.

Referring to FIGS. 5*a* and 5*d*, the body 7 defines a conduit 70 having first and second conduit apertures 71, 72 as will be described in more detail below. The first conduit aperture 71 corresponds to the first opening of the channel 21 and the second conduit aperture 72 corresponds to the second opening 22 of the channel 20. Around the mouth of each conduit aperture 71, 72, is a respective recess 71*a*, 72*a* formed in the surface of body 7 which provides a stepped lead-in to the conduit 70. FIG. 6 is a partial perspective lateral view of the rear of the article of footwear 1, the body 7 and core 8 being connected with the rest of the footwear 1, being covered with a leather material to match the upper 2 of the footwear 1, and also provided with the sleeve portion 6 which is inserted into the conduit 70 of the body 7 as will be described in greater detail below. The fastening means 5 is not shown in FIG. 6. The channel 20 of the heel portion 4 is defined primarily by internal walls 23 of the sleeve portion 6. Naturally, the sleeve portion 6 is hollow between its first and second open ends to allow the fastening means 5 to pass through it. Furthermore, the channel 20 has a bore profile that is substantially regular and smooth between the first and second openings 21, 22. The channel 20 and the sleeve portion 6 both have cross-sectional profiles that are tear-drop-shaped, with the point of the tear-drop facing down, and so tapering in the same direction as the heel.

Figure 7:
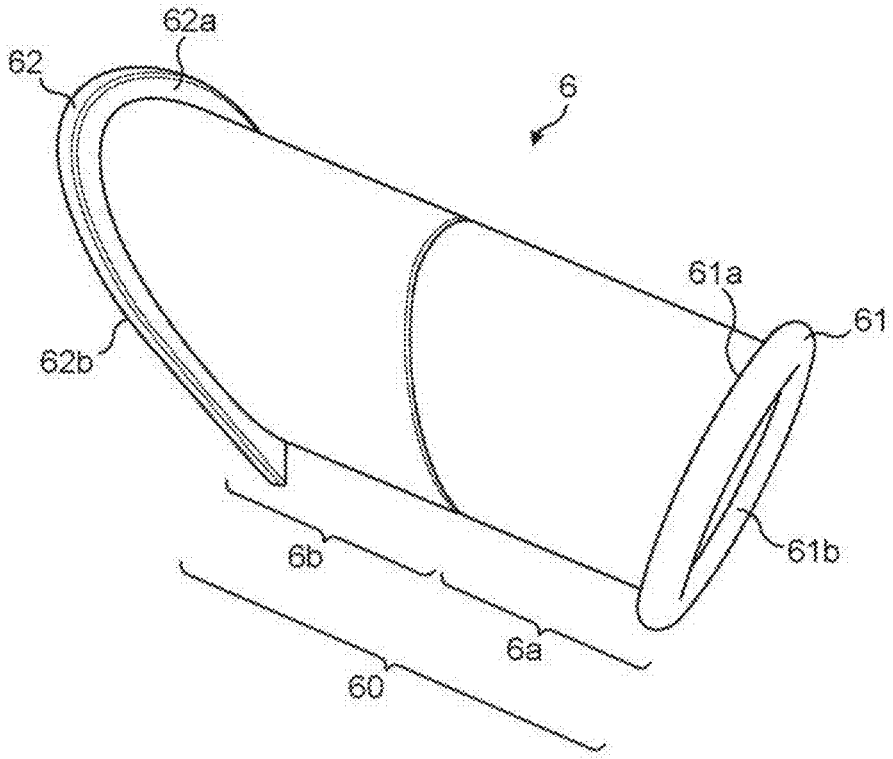
FIG. 7 is a perspective view of a sleeve portion of the article of footwear of FIG. 1.

FIG. 7 is a perspective view of the sleeve portion 6 in isolation. The sleeve portion 6 comprises a stem 60 the ends of which terminate at a first flange 61 and a second flange 62 respectively. The length of the stem 60 of the sleeve portion 6 substantially matches the length of the conduit 70 of the body 7 of the heel portion 4. The walls of the stem 60 of the sleeve portion 6 extend in a broadly tubular arrangement between its first and second open ends so the first and second open ends of the sleeve portion 6 thereby respectively correspond to the first and second openings 21, 22 of the channel 20 when the sleeve portion 6 is fitted to the rest of the heel portion 4. The flanges 61, 62 are of a similar tear-drop shape to the channel 20, and extend circumferentially beyond the walls of the stem 60.

The sleeve portion 6 is formed of two components, a first component 6*a* and a second component 6*b*, which are mirrored versions of one another. The first flange 61 comprises an inwardly-facing shoulder 61*a*, and an outwardly-facing region 61*b*. The second flange 62 comprises an inwardly-facing shoulder 62*a* and an outwardly-facing region 62*b*.

Each of the respective outwardly-facing regions 61*b*, 62*b* of the first and second flanges 61, 62 are rounded to avoid sharp edges being presented on an external surface of the article of footwear 1, around the respective first and second openings 21, 22 of the channel 20. Thus, when the sleeve portion 6 is fitted to the body 7, each flange 61, 62 defines a mantle around the respective first and second opening 21, 22 of the channel 20.

Each of the outwardly-facing regions 61*b*, 62*b* extend proud of the underlying main surface of the body 7 in the region of which the sleeve portion 6 is fitted. However, each flange 61, 62 locates into respective recesses 71*a*, 72*a* around the mouth of each respective conduit recess 71, 72 which are shaped in complement with the respective inwardly-facing shoulders 61*a*, 62*a* of the first and second flanges 61, 62.

Thus, in general, the inwardly-facing shoulder 61*a* of the first flange 61 is shaped and oriented in complement with a respective outwardly-facing surface of the body 7 corresponding to the first surface 41, so that, when the sleeve portion 6 is fitted to the body 7, the first flange 61 is engaged with the body 7 and is substantially flush with it. Similarly, the inwardly-facing shoulder 62*a* of the second flange 62 is shaped and oriented in complement with a respective outwardly-facing surface of the body 7 corresponding to the second surface 42. As mentioned earlier, these surfaces 41, 42 face predominantly laterally, but with a slight inclination downward towards the ground, and also to the rear of the article of footwear 1.

Figure 8:
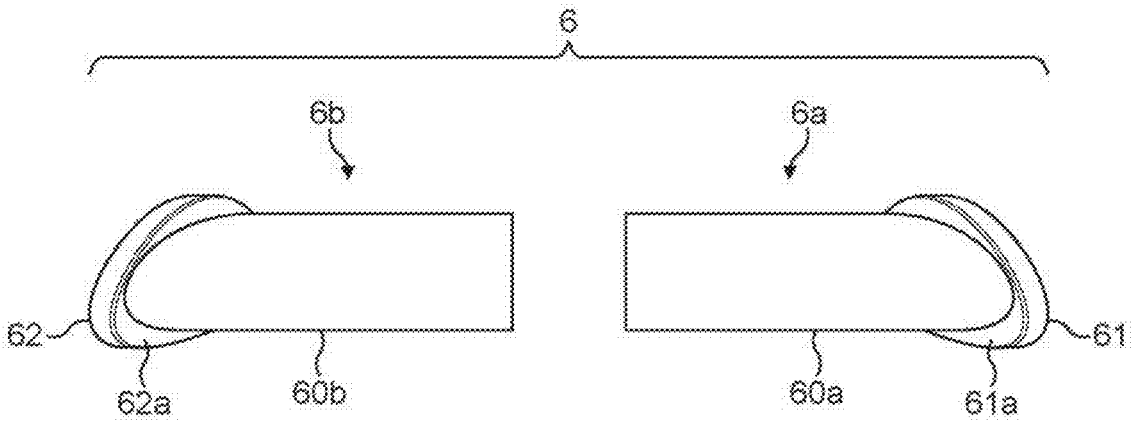
FIG. 8 is an overhead view of the sleeve portion of FIG. 7.

FIG. 8 is an overhead view of the sleeve portion 6 in isolation, the first and second components 6*a*, 6*b* of the sleeve portion 6 being shown separated, splitting the stem 60 into two parts. Moreover, the first component 6*a* comprises a first stem portion 60*a*, and the second component 6*b* comprises a second stem portion 60*b*.

General manufacture of the article of footwear 1 of the first embodiment will now be described.

The sleeve portion 6 is formed by casting it from brass, and then electroplating it with gold. Specifically, each component 6*a*, 6*b* is manufactured by casting the respective component 6*a*, 6*b* from an integral piece of brass, the casting performed using a silicon rubber mould. Each component 6*a*, 6*b*, is then electroplated with gold. The respective stem portions 60*a*, 60*b* of the two components 6*a*, 6*b* have substantially regular cross-sectional profiles, allowing their easy withdrawal from the casting mould.

The body 7 of the heel portion is injection-moulded from acrylonitrile butadiene styrene (ABS) around an upper part of the core 8. The conduit 70 of the body 7 results from the moulding process, and the regular internal cross-sectional profile of the conduit 70 allows withdrawing from the mould. The body 7 and protruding part of the core 8 are then covered with leather to match the upper 2 and then attached to the other parts of the sole 3, and the upper 2 in a manner conventional in the art. The heel tip 9 is attached to the core 8 via screw 9*a*.

The sleeve portion 7 is inserted, via sliding insertion, into the conduit of the body 7, with the two components 6*a*, 6*b* of the sleeve portion 6 being inserted into respective conduit apertures 71, 72 of the body 7. Specifically, the first stem portion 60*a* of the first component 6*a* is slid into the first conduit aperture 71 of the conduit 70 of the body 7, and the second stem portion 60*b* of the second component 6*a* is slid into the second conduit aperture 72 of the conduit 70 of the body 7. Upon full insertion, the respective ends of the first and second stem portions 60*a*, 60*b* meet within the conduit 70 and the flanges 61, 62, which are too big to fit into the conduit 70, meet with their respective external laterally-facing surfaces of the body 7, as defined by respective recesses 71*a*, 72*a*. Prior to insertion, adhesive is applied to the meeting ends of the first and second stem portions 60*a*, 60*b*, and following insertion, the adhesive binds the two pieces of the sleeve portion 6 together.

The internal cross-sectional profile of the conduit 70 and an external cross-sectional profile of the stem of the sleeve portion 6 inserted into the conduit 70 closely conform to one another so that the two halves of the sleeve portion 6 can be slid into the conduit 70, but are securely embedded within the conduit 70 via an interference fit. The interference fit augments the binding action of the adhesive.

When construction of the heel portion 4 is complete, it is attached to the other parts of the sole 3, such as the shank and the outsole, and then the sole 3 is connected to the upper 2.

The order in which the different parts of the article of footwear 1 are attached to one another can vary. For example, the body 7 can receive the sleeve portion 6 before or after attachment to the other parts of the sole 3 or upper 2. However, it is generally preferred that the step of covering the body 7 with a material such as leather is carried out before insertion of the sleeve portion 6, as the flanges 61, 62 of the sleeve portion 6 can cover imperfections in the material around the openings 21, 22, and moreover can clamp on to that material. In other words, the flanges 61, 62 can be used to mask a region of the heel portion for which it may be difficult to achieve a good finish.

A similar process applies to the manufacture of the other article of the footwear pair.

General use of the article of footwear 1 of the first embodiment will now be described.

A wearer inserts their foot into the article of footwear 1, and can elect to wear it as a slip-on type, or a non-slip on type. Quick and easy conversion between the two types is possible, even when the article of footwear 1 is worn and so fully engaged with the foot, and moreover, such conversion can be easily performed by the same wearer of the article of footwear 1 as will now be described.

In a non-slip-on configuration, the fastening means 5 is arranged to fasten the article of footwear 1 to the foot 10 of the wearer. The fastening means loops around the dorsal region of the foot 10 of the wearer of the footwear 1, and loops through the channel 20, with the central portion 52 of the fastening means 5 extending through and being captured by the channel 20.

The buckle 51 can be releasably fastened in a conventional manner, by looping the end having the buckle 51 around to the other end at which the strap 50 has holes spaced at intervals along its length. This other end thereby effectively defines a fastening structure that complements the buckle 51 to allow releasable connection to make or break the loop, and moreover allows the effective length of the fastening means to be adjusted for comfortable engagement with the foot 10 of the wearer. Additionally, for comfort, the fastening means 5 is flat in the region that engages with the dorsal region of the wearer's foot. To facilitate correct orientation of the fastening means 5 with the dorsal region of the foot, such that the flatter part of the fastening means 5 is flush therewith, the fastening means 5 is able to pivot freely, without twisting or buckling, relative to the channel 20. To this end, the cross-sectional area of a central portion of the fastening means 5 that extends through the channel 20 is significantly smaller than the cross-sectional size of the bore of the channel 20. The linear path along which the channel 20 extends defines the pivot axis of the fastening means.

For conversion to a slip-on type of footwear, the buckle 51 can be unfastened to break the loop, and the wearer can then unthread the fastening means 5 from the channel 20 by pulling on the buckle end, which is otherwise too large to pass through the channel 20. Thus, the rest of the strap 50 can be pulled through the channel 20. This can be achieved without removal of the footwear 1.

A reverse operation of threading that end of the strap 50 through the channel is all that is required to convert the footwear 1 from a slip-on type back into a non-slip-on type. Again, this can be achieved without removal of the footwear 1. The smooth bore of the channel 60 allows a reverse operation of threading the fastening means 5 into the channel 20 to be carried out with ease. The end of the fastening means 5 that doesn't support the buckle 51 can be manually urged by the wearer through one of the first and second openings 21, 22. Doing so guides this end smoothly by the internal walls 23 so as to exit from the other of the first and second openings 22, 21, and thus is available for looping connection to the buckle 51 around the dorsal region of the foot 10 of the wearer.

The strap 50 is constructed from leather, and has enough stiffness to be guided through the length of the channel 20. Additionally, there is relatively little friction between the strap 50 and the internal walls 23 surrounding the channel 20 which is plated with gold.

Notably, the openings 21, 22 of the channel are situated external to the footwear 1, and so are accessible to the wearer of the footwear 1 for convenient threading or unthreading of the fastening means 5. Moreover, the channel 20 is oriented such that ends of a fastening means 5 that emerge from the channel 20 extend laterally away from one another and also from the foot 10 of the wearer. This makes it easier for a wearer to simply bend down and pick up these free ends with respective left and right hands, and then loop them about the dorsal region of the wearer's foot.

A wearer can unfasten the fastening means 5 to remove the footwear 1 entirely, but the fastening means 5, via its central portion 52, can remain captured by the channel 20 and so does not easily part from the rest of the footwear 1. This reduces the chance of the fastening means 5 becoming lost.

Furthermore, the tear-drop shape of the sleeve portion 6 is relatively elongate in the same orientation as the heel, thereby enabling the fastening means 5 to lie across the top of the shoe when not worn. Moreover, a bottom edge of the fastening means 5 is seated in the lower tip of the channel 20, and so the channel 20 frictionally engages the fastening means 5 when the fastening means 5 is unfastened. This reduces accidental lateral slippage through the channel, making it easier to put on the article of footwear 1 without the fastening means 5 unintentionally coming away from the channel 20. However, when the fastening means is looped over the dorsal region of the foot, it rides smoothly up the front curved part of the tear-drop-shaped channel 20, without twisting the fastening means, and so prevents the fastening means from encountering shear forces which may weaken it over time.

Figure 9:
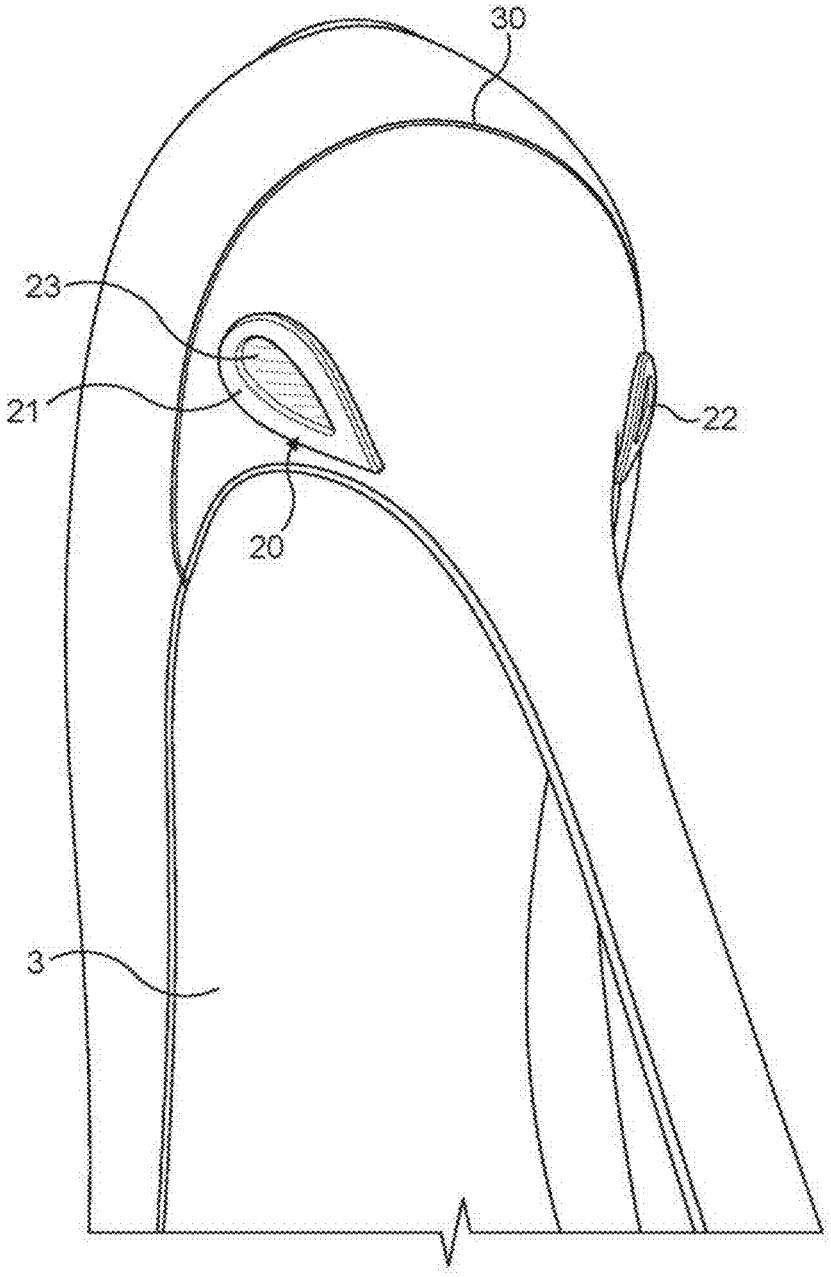
FIG. 9 is a partial perspective underneath view of an article of footwear in accordance with a second embodiment of the present invention.

FIG. 9 is a partial perspective underneath view of an article of footwear in accordance with a second embodiment of the present invention. The key features of this second embodiment are identical to the first, and so, for brevity, are not repeated. However, the main difference is the material from which the upper 2 is constructed, and with which the body of the heel portion is covered. Rather than being leather, as in the first embodiment, the material is a suede fabric.

Other alternatives to, and advantages of the above-described embodiments will be apparent to a person skilled in the art.

For example, one of the advantages associated with the tear-drop-shaped cross-sectional profile of the channel 20 is that it provides a good trade-off between the bore size of the channel 20, and the strength of the heel portion 4. Conformity between the bore of the channel 20 and the surrounding structures minimise stress concentrations in any one particular part of those surrounding structures. However, channels of other cross-sectional profiles may be possible in alternatives. For example, the cross-sectional profile of the channel may be circular or oval in shape.

Another advantage is associated with the use of brass as a material for the sleeve portion 6. This is a particularly cost-effective, easy-to-work, rigid and durable material that maintains its form despite frictional forces during insertion of the sleeve portion 6 into the body 7 during assembly, and also under the loading forces transmitted to it during wear of the article of footwear 1. It is also easy to clean. However, other such materials can be used instead. For example, a different metal can be used. A metal is generally preferred as this permits electroplating with an aesthetically-pleasing or otherwise precious or desirable material such as gold, platinum, silver and the like.

The ease with which the fastening means 5 can be threaded and unthreaded from the channel 20 also facilitates customisation of the article of footwear 1. It is relatively straightforward to swap different types and styles of fastening means 5, for example, having different colours, materials, buckles and straps.

Naturally, the fastening means 5 is not necessarily limited to a buckle 51 and strap 50. In alternatives, the fastening means may be of a different form. For example, the fastening means may comprise materials such as leathers, textiles, chains, or a combination thereof. Additionally, the fastening means may provide other means by which ends can be looped together, for example, cooperating hook-and-loop fasteners, snap-engaging poppers, buttons, press-studs, latches, clips, zips and the like. Whilst relatively flat structures, such as pads or bands, are preferred for comfort, other general shapes are possible for the region of the fastening means that engages with a wearer's foot.

Although the invention has been described in conjunction with specific embodiments thereof, it is evident that many alternatives, modifications and variations will be apparent to those skilled in the art. Accordingly, it is intended to embrace all such alternatives, modifications and variations that fall within the scope of the appended claims.

The invention claimed is:

1. An article of footwear comprising a heel portion for supporting a heel of a foot of a wearer, the heel portion defining a channel extending uninterrupted from a first opening situated at a first laterally-facing surface of the heel portion to a second opening situated at a second laterally-facing surface of the heel portion, the first and second laterally-facing surfaces being opposed to one another, the article of footwear further comprising a fastening means for fastening the article of footwear to the foot of the wearer, the fastening means being arranged to extend through said channel and, in use of the footwear, is fastenable around the dorsal region of the foot of the wearer of the article of footwear wherein the heel portion comprises:

a sleeve portion positioned and arranged to surround and define the channel; and a body comprising a conduit within which at least a stem of the sleeve portion is inserted;

wherein an internal cross-sectional profile of the conduit and an external cross-sectional profile of the stem of the sleeve portion inserted into the conduit, closely conform to one another so that the stem of the sleeve portion is securely embedded within the conduit.

2. The article of footwear according to claim 1, wherein the channel is positioned and arranged to be accessed by a wearer when the article of footwear is being worn by the wearer, thereby allowing the wearer to convert the footwear between a slip-on and non-slip-on type without removing the article of footwear.

3. The article of footwear according to claim 2, wherein the first and second laterally-facing surfaces are external surfaces of the heel portion that face outward, and away from one another.

4. The article of footwear according to claim 1, having only a single channel through which the fastening means extends, the fastening means, when fastened, forming a complete loop that passes through the channel and, in use of the footwear, also around the foot of the wearer to retain the footwear to the foot of the wearer.

5. The article of footwear according to claim 1, wherein the fastening means comprises a fastener situated at one end of the fastening means and a complementary fastening structure at another end, the fastener and the complementary fastening structure being releasably connectable with one another, the connection of the fastener and the complementary fastening structure forming a loop, and disconnection breaking that loop.

6. The article of footwear according to claim 1, wherein a bore profile of the channel is substantially regular between the first and second openings, the channel comprising smooth internal walls allowing a fastening means manually urged through one of the first and second openings to be guided by the internal walls so as to exit from the other of the first and second openings.

7. The article of footwear according to claim 1, wherein the stem of the sleeve portion is securely embedded within the conduit via an interference fit, at least one of the ends of the sleeve portion is situated at an external region of the body of the heel portion to define at least one of the first and second openings of the heel portion, the sleeve portion is constructed of a material that is stronger than the material from which the body is constructed, the sleeve portion defines a mantle around at least one of the first and second openings of the channel, the sleeve portion is constructed from a plurality of components, a first component comprising a first portion of the stem and a second component comprising a second portion of the stem, the first and second components being fitted by driving them into the conduit of body via respective first and second conduit apertures, and at least one of the first and second components are cast from an integral piece of material and the sleeve portion comprises one or more flanges, each flange being located at a respective end of the sleeve portion.

8. The article of footwear according to claim 7, wherein at least one of the flanges has an external cross-sectional profile that prevents insertion into the conduit of the body so as to limit the depth of insertion of the sleeve portion into the conduit of the body, at least one of the flanges defines a mantle around a respective opening of the channel, at least one of the flanges comprises an inwardly-facing shoulder, shaped and oriented in complement with a respective outwardly-facing surface of the body to facilitate even engagement between the flange and the body, and at least one of the flanges comprises an outwardly-facing region that is rounded to avoid sharp edges being presented on an exterior of the article of footwear.

9. The article of footwear according to claim 1, wherein the heel portion comprises a core extending between a heel seat of the article of footwear, and the ground on which the article of footwear stands in normal use, with the channel extending across a path that avoids the core.

10. The article of footwear according to claim 1, wherein a cross-sectional profile of the channel tapers inwardly towards the ground, tapering in conformity with a corresponding tapering of the heel portion.

11. The article of footwear according to claim 1, wherein a cross-sectional profile of the channel is of a broadly tear-drop shape.

12. The article of footwear according to claim 1, wherein the channel is situated at the front of the heel portion, close to a transition between the heel portion and an arch of the article of footwear, with the channel extending laterally across the width of the heel portion of the footwear, the channel being oriented such that ends of a fastening means that emerge from the channel extend laterally away from one another and also from a foot of the wearer of the article of footwear.

13. The article of footwear according to claim 1, wherein the cross-sectional area of a central portion of the fastening means that extends through the channel is less than 60% of the cross-sectional size of the bore of the channel.

14. The article of footwear according to claim 1, wherein the article of footwear comprises an upper for covering at least a portion of an upper part of a wearer's foot, the upper being arranged to form an interference fit with a foot of the wearer of the article of footwear, the upper presenting a substantially continuous external surface.

15. The article of footwear according to claim 1, wherein the first and second openings are situated at laterally opposed positions on the heel portion at substantially the same height from the ground on which the article of footwear stands in normal use, with the channel being level relative to the ground on which the footwear stands in normal use.

16. The article of footwear according to claim 1, wherein the channel is situated closer to a heel seat of the article of footwear than the ground.

17. An article of footwear of a slip-on type arranged for conversion to a non-slip-on type, the article of footwear comprising a heel portion for supporting a heel of a foot of a wearer, the heel portion defining a channel extending from a first opening situated at a first laterally-facing surface of the heel portion to a second opening situated at a second laterally-facing surface of the heel portion, the first and second laterally-facing surfaces being opposed to one another, conversion to a non-slip-on type of footwear resulting from manual threading of a fastening means through said channel, the fastening means being arranged to loop around the foot of the wearer of the article of footwear, in use, so as to fasten the article of footwear thereto wherein the heel portion comprises:

a sleeve portion positioned and arranged to surround and define the channel; and a body comprising a conduit within which at least a stem of the sleeve portion is inserted;

wherein an internal cross-sectional profile of the conduit and an external cross-sectional profile of the stem of the sleeve portion inserted into the conduit, closely conform to one another so that the stem of the sleeve portion is securely embedded within the conduit.

18. The article of footwear according to claim 11, wherein the point of the tear-drop faces down towards the ground on which the article of footwear stands in normal use.

* * * * *